US008123562B2

(12) United States Patent
Zhou et al.

(10) Patent No.: US 8,123,562 B2
(45) Date of Patent: Feb. 28, 2012

(54) ELECTRICAL CONNECTOR ASSEMBLY WITH IMPROVED CONTACT SOLDERING ENDS

(75) Inventors: Jun Zhou, Shenzhen (CN); Yong-Hui Hu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/913,806

(22) Filed: Oct. 28, 2010

(65) Prior Publication Data

US 2011/0124238 A1 May 26, 2011

(30) Foreign Application Priority Data

Nov. 25, 2009 (CN) ..... 2009 2 0315769
Dec. 21, 2009 (CN) ..... 2009 2 0317935
Dec. 23, 2009 (CN) ..... 2009 2 0318167

(51) Int. Cl.
*H01R 13/648* (2006.01)

(52) U.S. Cl. ..... 439/607.48; 439/630; 439/874

(58) Field of Classification Search ..... 439/607.41–607.52, 874–876, 630, 676
See application file for complete search history.

(56) References Cited

U.S. PATENT DOCUMENTS

| | | | | |
|---|---|---|---|---|
| 5,167,531 | A * | 12/1992 | Broschard et al. | 439/541.5 |
| 5,653,617 | A * | 8/1997 | Seidler | 439/876 |
| 6,231,393 | B1 * | 5/2001 | Lai | 439/607.44 |
| 6,364,702 | B1 * | 4/2002 | Mochizuki et al. | 439/579 |
| 6,736,676 | B2 * | 5/2004 | Zhang et al. | 439/607.22 |
| 6,739,912 | B2 * | 5/2004 | Korsunsky et al. | 439/620.15 |
| 7,736,190 | B2 * | 6/2010 | Yuan et al. | 439/660 |
| 7,806,735 | B1 * | 10/2010 | Chen et al. | 439/676 |
| 2007/0155243 | A1 * | 7/2007 | Watanabe et al. | 439/610 |
| 2010/0112863 | A1 | 5/2010 | Xiao et al. | |

* cited by examiner

*Primary Examiner* — Gary F. Paumen
(74) *Attorney, Agent, or Firm* — Ming Chieh Chang; Wei Te Chung; Andrew C. Cheng

(57) ABSTRACT

An electrical connector assembly (100) includes an insulative housing (1), a number of contacts (2) assembled in the insulative housing, a cable (4) welded with the contacts. The insulative housing includes a base portion (11), a tongue portion (12) integral with the base portion for defining a mating direction. The contacts has a number of contacting portions (212, 222) received in the tongue portion and partly extending beyond the tongue portion and a number of soldering portions (211, 221) extending rearward out of the base portion. The soldering portions include at least one pair of upper-and-lower soldering portions (26, 28, 27, 29). Each upper soldering portion opposingly faces a corresponding lower soldering portion in a vertical direction perpendicular to the mating direction. The cable is connected with respective soldering portions of the contacts.

19 Claims, 7 Drawing Sheets

ELECTRICAL CONNECTOR ASSEMBLY WITH IMPROVED CONTACT SOLDERING ENDS

BACKGROUND OF THE INVENTION

1. Field of the Invention

The present invention relates generally to an electrical connector assembly, and more particularly to a USB (Universal Serial Bus) connector assembly with improved contact soldering ends for crosstalk reduction.

2. Description of Related Arts

Personal computers (PC) are widely used today. Universal Serial Bus (USB) is a serial bus standard to the PC architecture which focuses on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method. Furthermore, due to the need for high speed signal transmission of electronic products, USB 3.0 connectors have been adopted.

U.S. Patent Application Publication No. 2010/0112863 published on May 6, 2010 discloses a USB 3.0 connector. The USB 3.0 connector comprises an insulative body including integral forward part and backward part. The forward part is split into a narrow tongue and a wide tongue disposed in a common plane. The narrow tongue and the wide tongue are spaced a distance from each other at front ends thereof. The USB 3.0 connector comprises a plurality of first contacts received in the narrow tongue and a plurality of second contacts received in the wide tongue, respectively transmitting differential signals. Each contact comprises a contacting portion extending beyond an upper surface of the frontward part of the insulative housing and a soldering portion extending out of the backward part and thus, exposed outside the insulative housing. The contacts are soldered with wires of a cable, and during the process, the soldering portions of the contacts are prone to be damaged, because no protection is provided to the soldering portions. Furthermore, a shield covers the insulative housing and an insulative cover is usually molded over the shield, and the soldering portions of the contacts might be deflected during the molding process. Two adjacent soldering portions may connect with each other and shorting occurs subsequently.

Additionally, the contacting portions extend in a first, same horizontal plane and the soldering portions extend alternately, both upwardly and downwardly relative to the corresponding contacting portions, at different horizontal planes from the first horizontal plane. Because each contact extends straight along a mating direction, each soldering portion is offset with respect to adjacent soldering portions in a top view. Therefore, the impedance thereof is large and may hinder high speed signal transmission, although two differential signals are transmitted. Finally, the first contacts comprise a pair of transmitting contacts, a pair of receiving contacts, and a grounding contact located at the same side of the transmitting contacts and receiving contacts and so do the second contacts. The transmitting contacts and the receiving contacts are so close that crosstalk may occur therebetween. Since the grounding contact is disposed at the same side of the transmitting contacts and the receiving contacts rather than disposed between the transmitting contacts and receiving contacts, grounding effect is reduced.

Hence, an electrical connector assembly with improved contact soldering ends for crosstalk reduction is desired to overcome the aforementioned disadvantage of the prior art.

SUMMARY OF THE INVENTION

Accordingly, an object of the present invention is to provide an electrical connector assembly with improved contact soldering ends for crosstalk reduction.

To achieve the above object, an electrical connector assembly includes an insulative housing, a number of contacts assembled in the insulative housing, a cable welded with the contacts. The insulative housing includes a base portion, a tongue portion integral with the base portion for defining a mating direction. The contacts has a number of contacting portions received in the tongue portion and partly extending beyond the tongue portion and a number of soldering portions extending rearward out of the base portion. The soldering portions include at least one pair of upper-and-lower soldering portions. Each upper soldering portion opposingly faces a corresponding lower soldering portion in a vertical direction perpendicular to the mating direction. The cable is connected with respective soldering portions of the contacts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
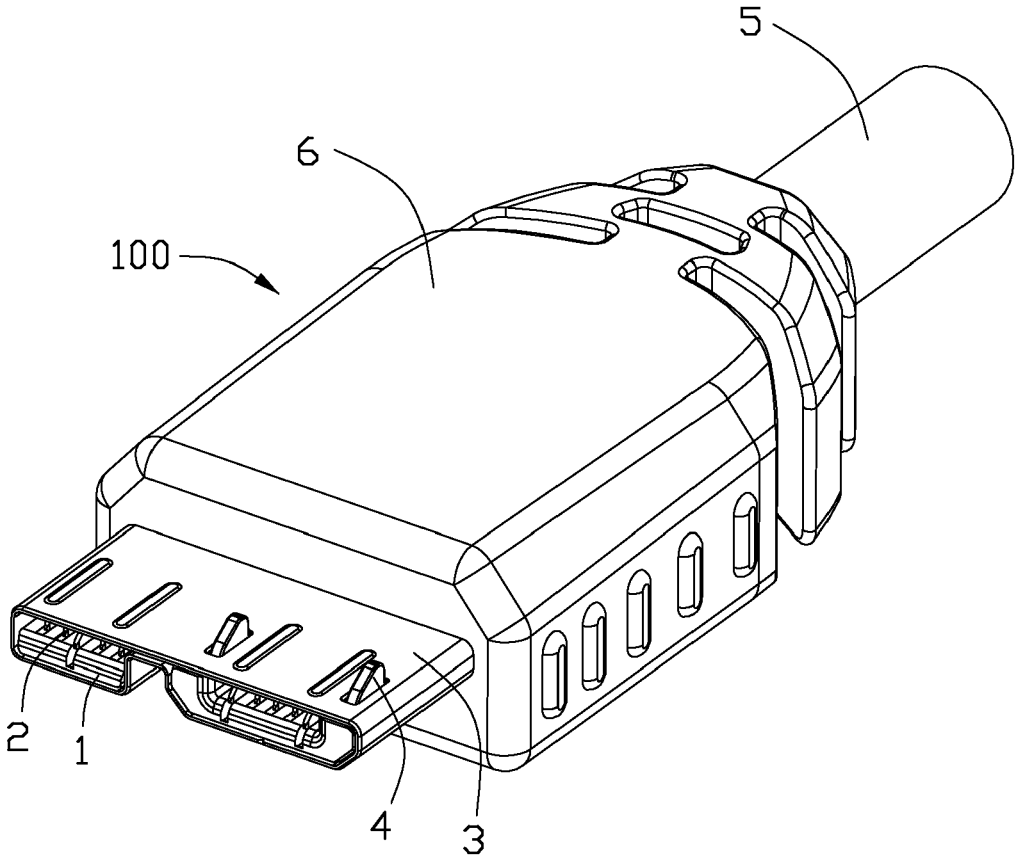
FIG. 1 is a perspective, assembled view of an electrical connector assembly constructed in accordance with the present invention.
Figure 2:
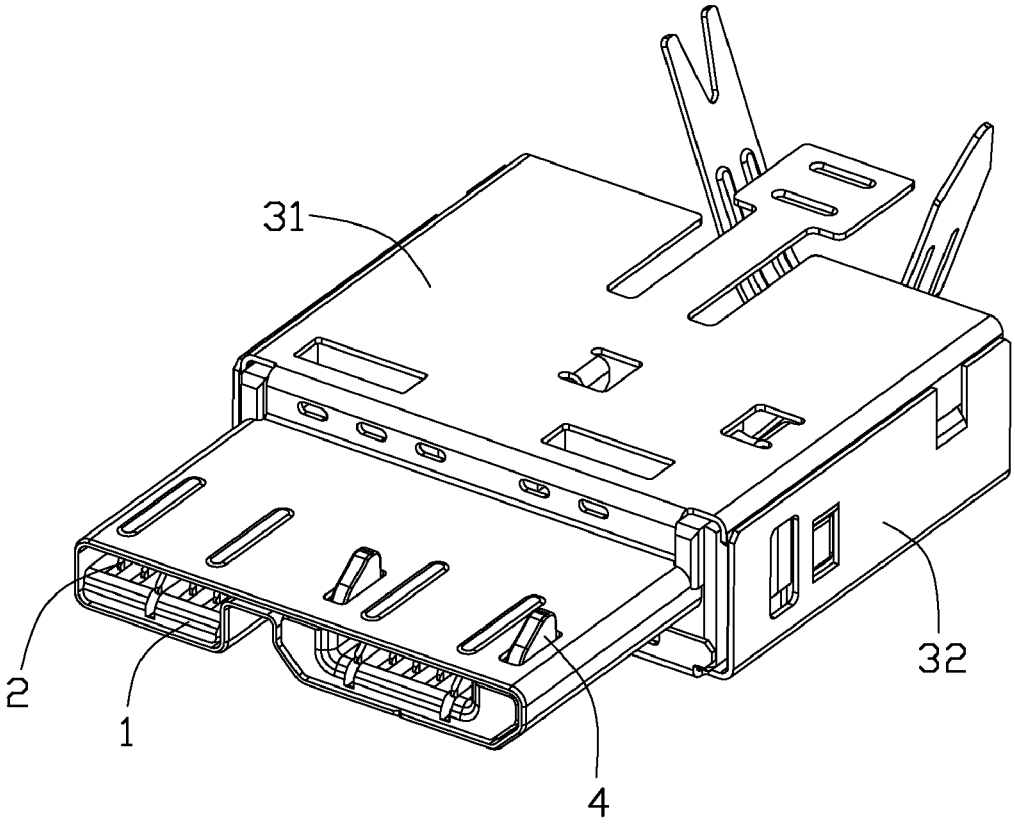
FIG. 2 is a perspective, partly assembled view of the electrical connector assembly when an insulative cover and a cable are not shown.

Reference will now be made in detail to the preferred embodiment of the present invention.

Referring to FIGS. 1-7, a USB 3.0 connector assembly 100 in accordance with the present invention used for transmitting high speed differential signals, comprises an insulative housing 1, a plurality of contacts 2 and a pair of latches 4 assembled in the insulative housing 1, a shield 3 covering the insulative housing 1, a cable 5 connecting with the contacts 2, and an insulative cover 6 partly molding outside of the shield 3 and the cable 5.

Referring to FIGS. 3-6, the insulative housing 1 comprises a base portion 11 and a tongue portion 12 extending forwardly from the base portion 11. The tongue portion 12 is arranged lower than the base portion 11 for facilitating connection with a mating connector (not shown) along a mating direction. The base portion 11 extends along a transverse direction perpendicular to the mating direction. The base portion 11 defines an upper surface 111, a lower surface 112 opposite to the upper surface 111, a pair of side surfaces 113 connecting with the upper surface 111 and the lower surface 112, a front surface 114 from which the tongue portion 12 extends, and a rear surface 115 opposite to the front surface 114. Each side surface 113 forms a protrusion 1131. The tongue portion 12 comprises a first, wide mating tongue 121 and a second, narrow mating tongue 122 arranged at a same level as the first, wide mating tongue 121. The first, wide mating tongue 121 comprises a first connecting portion 1210 integral with the base portion 11 and a first mating portion 1212 integrally, forwardly extending from the first connecting portion 1210. Correspondingly, the second, narrow mating tongue 122 comprises a second connecting portion 1220 integral with the base portion 11 and a second mating portion 1222 integrally, forwardly extending from the second connecting portion 1220. The first mating portion 1212 spaces a little distance away from the second mating portion 1222. The first connecting portion 1210 integrates with the second connecting portion 1220 for increasing intensity of the tongue portion 12. The first mating tongue 121 defines a plurality of first passageways 1213 and the second mating tongue 122 defines a plurality of second passageways 1223. The first passageways 1213 and the second passageways 1223 extend through the insulative housing 1 along the mating direction and backwardly end at the rear surface 115 of the base portion 11. Additionally, the first mating tongue 121 defines a pair of slots 1214 at two sides of the first passageways 1213 for receiving the latches 4. The base portion 10 forms a plurality of ribs 13 extending rearward from the rear surface 115 along the mating direction. The ribs 13 and the tongue portion 12 are located at opposite sides of the base portion 11.

Figure 3:
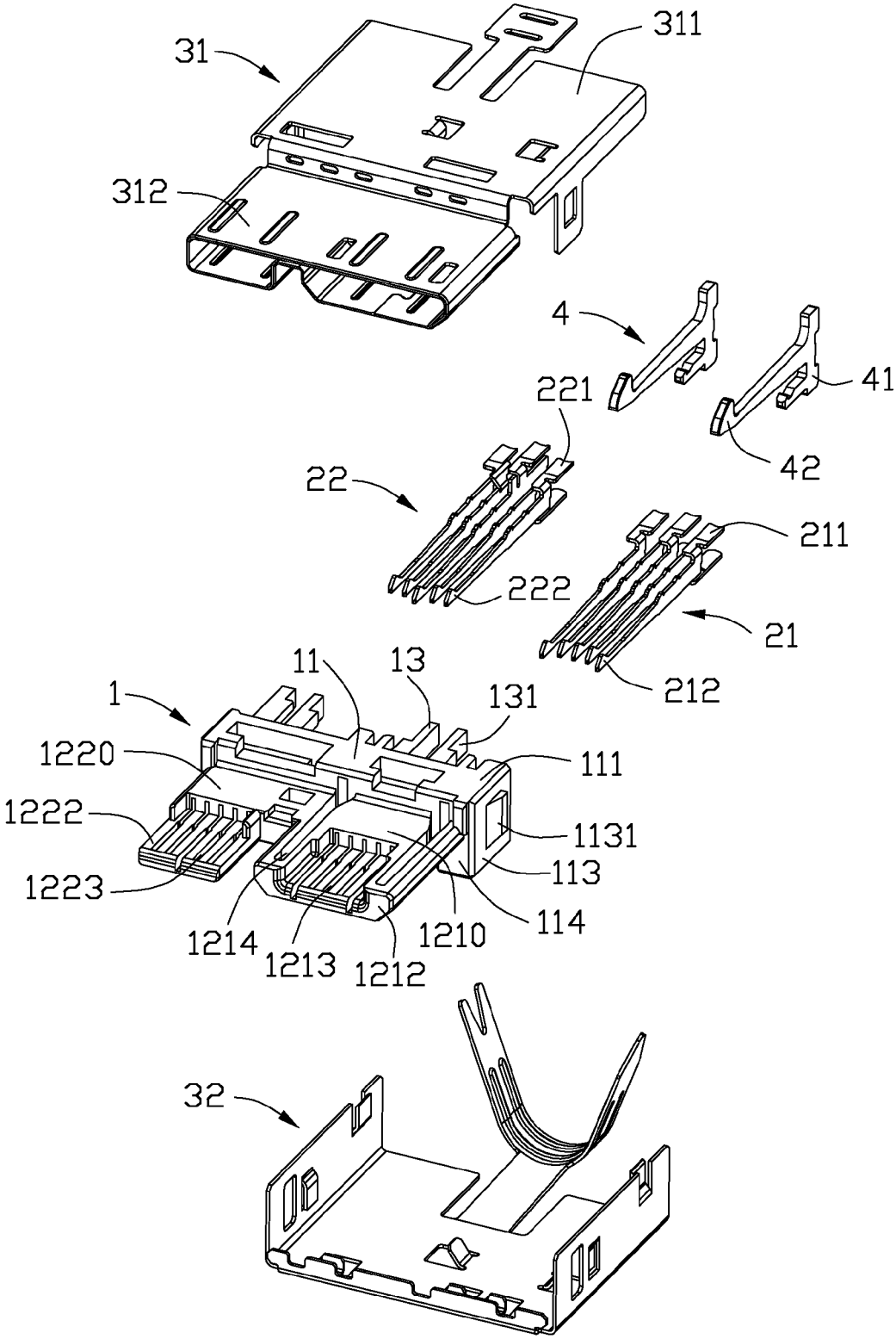
FIG. 3 is a perspective, fully exploded view of FIG. 2.
Figure 4:
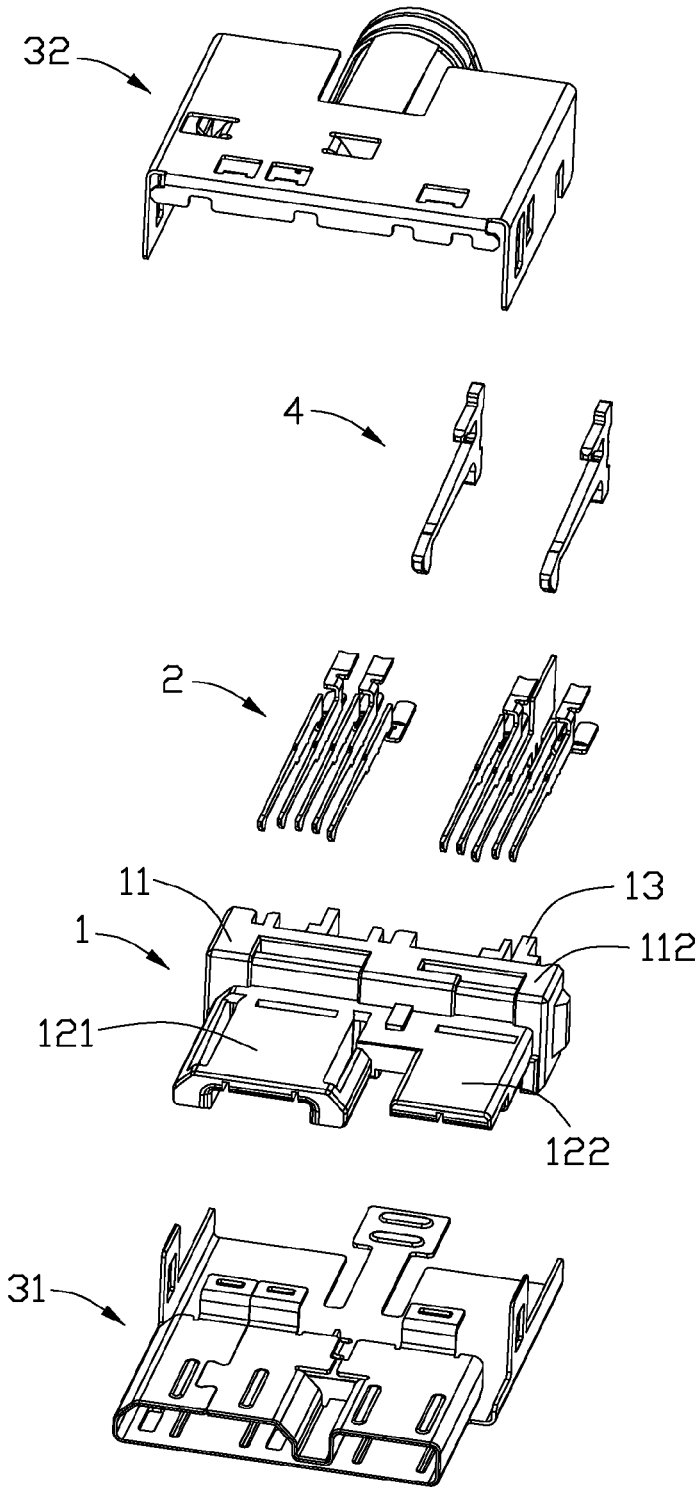
FIG. 4 is another fully exploded view similar to FIG. 3 but taken a different aspect.
Figure 5:
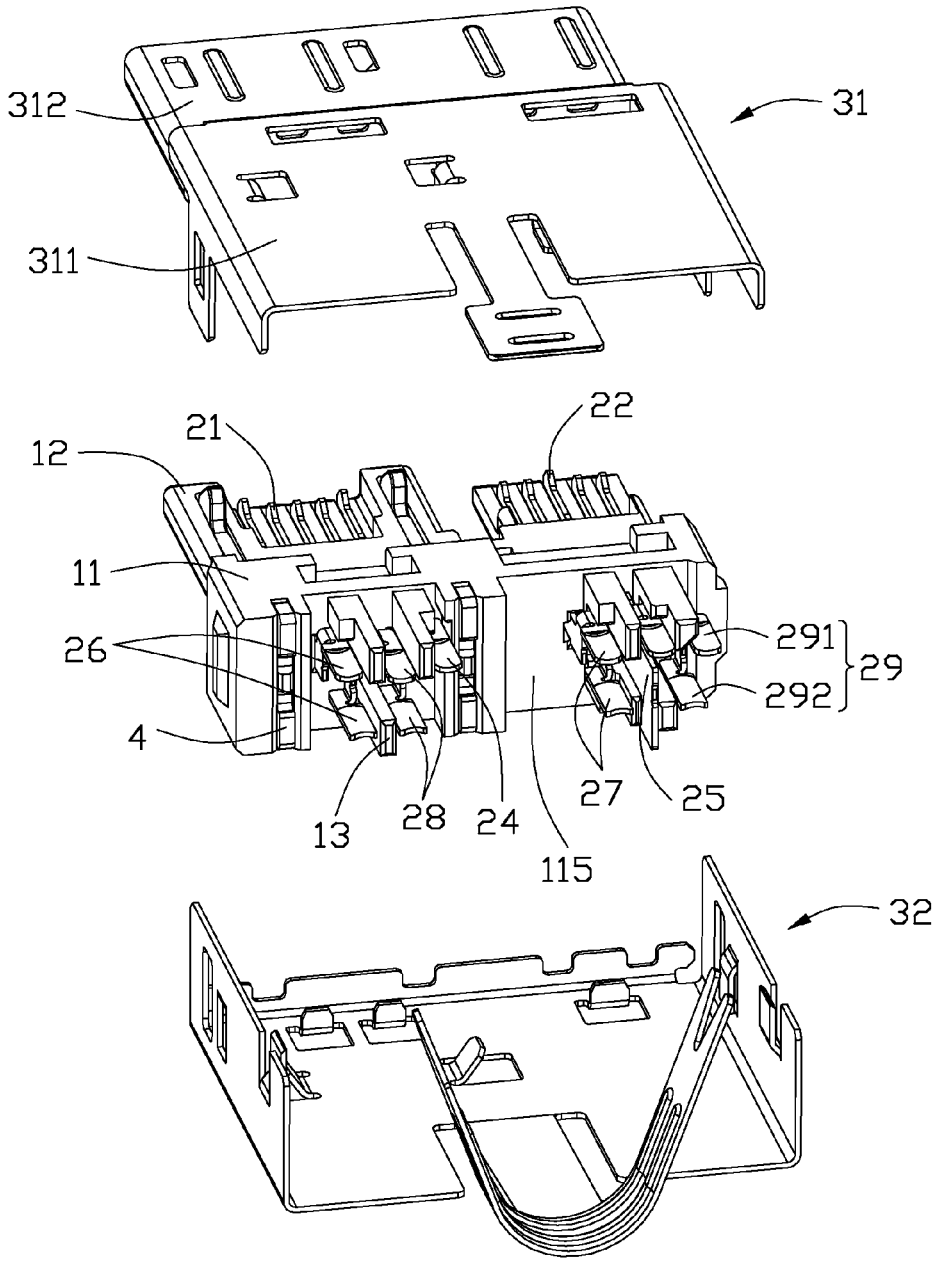
FIG. 5 is a perspective, partly exploded view of FIG. 2.
Figure 6:
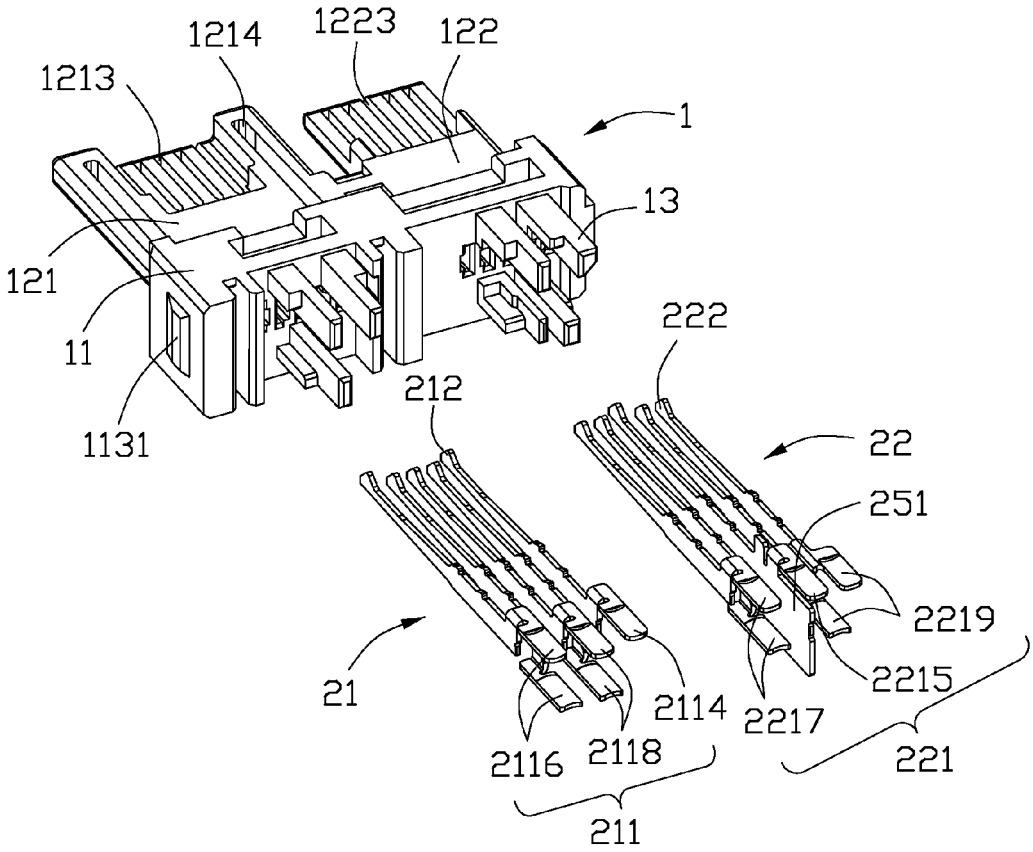
FIG. 6 is a perspective, exploded view of the insulative housing and the contacts.

Referring to FIGS. 3, 5, and 6, the contacts 2 have a group of first terminals 21 which are assembled in the first tongue portion 121 of the insulative housing 1 and a group of second terminals 22 which are assembled in the second tongue portion 122 of the insulative housing 1. Each of the first terminal 21 and the second terminal 22 has a soldering portion 211/221 and a contacting portion 212/222 at front of the soldering portion 211/221. The contacts 2 are received in the corresponding passageways 1213, 1223 of the insulative housing 1 and the contacting portions 212, 222 extend beyond the mating portions 1212, 1222 for engaging with the mating connector, while the soldering portions 211, 221 extend out of the base portion 1 from the rear surface 115 for connecting with the cable 5. Each contacting portion 212/222 extends in a vertical plane while the soldering portions 211/221 alternately bend upwardly or downwardly from the corresponding contacting portions 212/222. The soldering portions 211, 221 extend in parallel, horizontal planes. The ribs 13 divide the soldering portions 211, 221 one from the other and the soldering portions 211, 221 are leaned against the adjacent ribs 13. In a preferred embodiment of the present invention, certain rib 13 defines a cutout 131 for accommodating a corresponding soldering portion 211/221. The ribs 13 amount to a number which at least makes sure that the first soldering portions 211 of the first terminals 21 extending along the same horizontal planes separated from each other and makes sure that the second soldering portions 221 of the second terminals 21 extending along other same horizontal planes separated from each other, too. Furthermore, each rib 13 extends at least up to rear edges of the soldering portions 211, 221 of the contacts 2's extension for protecting the contacts 2.

Figure 7:
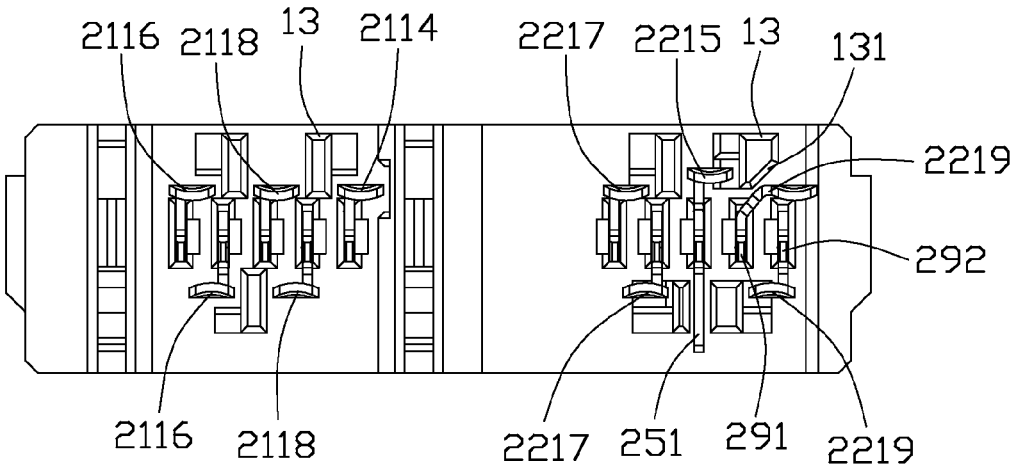
FIG. 7 is a rear elevational view of the insulative housing when the contacts are retained in the insulative housing.

Referring to FIGS. 5-7, the first terminals 21 comprise a pair of first transmitting terminals 26, a pair of first receiving terminals 28, and a first grounding terminal 24. The first grounding terminal 24 is disposed at the right side of the first receiving terminals 28 and the first transmitting terminals 26 are disposed at the left side of the first receiving terminals 28 along the transverse direction. The second terminals 22 comprise a pair of second transmitting terminals 27, a pair of second receiving terminals 29, and a second grounding terminal 25. Different to the first grounding terminal 24, the second grounding terminal 25 is disposed between the second transmitting terminals 27 and the second receiving terminals 29 along the transverse direction. Each of the first transmitting terminals 26, the first receiving terminals 28, the second transmitting terminals 27, and the second receiving terminals 29 comprise a pair of soldering portions 2116/2118/2217/2219 with one thereof extending upward and then rightward bending, while the other one extending downward and then leftward bending such that the pair of soldering portions 2116/2118/2217/2219 opposingly face towards each other in a vertical direction perpendicular to both the mating direction and the transverse direction. The first grounding terminal 24 comprises a soldering portion 2114 extending upwardly and being coplanar with the upper soldering portion 2116 of one first transmitting terminal 26 as well as the upper soldering portion 2118 of one first receiving terminal 28 in this embodiment. The soldering portion 2114 of the first grounding terminal 24 alternatively extends downward to be coplanar with the lower soldering portion 2116 of the other first transmitting terminal 26 as well as the lower soldering portion 2118 of the other first receiving terminal 28 in an alternative embodiment of the present invention. The second grounding terminal 25 comprises a soldering portion 2215 extending upwardly and being coplanar with the upper soldering portion 2217 of one second transmitting terminal 27 as well as the upper soldering portion 2219 of one second receiving terminal 29 in this embodiment. The second grounding terminal 25 further comprises a main plate 251 extending in the vertical direction, being located below the soldering portion 2215 and separates the soldering portions 2217, 2219 of the second terminals 22 at opposite sides for preventing crosstalk.

Referring to FIGS. 5 and 7, particularly, one receiving terminal 291 of the second receiving terminals 29 is located nearer to the grounding terminal 25 than the other one receiving terminal 292. The one receiving terminal 291 slantwise extend upward and then horizontally bends to extend over the other one receiving terminal 292 for facilitating welding with the cable 5.

Referring to FIG. 3, each latch 4 comprises a retaining portion 41 and a locking portion 42 extending forward from the retaining portion 41. The latches 4 are both assembled in the slots 1214 of the first tongue portion 121. The latches 4 are disposed at opposite sides of the first contacts 21.

Referring to FIGS. 1-5, the shield 3 comprises a first, upper metal cover 31 and a second, lower metal cover 32 attached to the first, upper metal cover 31. The upper metal cover 31 comprises a flat portion 311 and a casing portion 312 extending from the flat portion 311. The casing portion 312 essentially covers the tongue portion 12. The lower metal cover 32 are attached to the flat portion 311 of the upper metal cover 31 and associates with the flat portion 311 for covering the base portion 11 of the insulative housing 1. The latches 4 projects upwardly out of the casing portion 312 of the shield 3 when assembled.

The cable 5 has wires (not shown) respectively soldered to the contacts 2. The insulative cover 6 is partly molded outside of the shield 3 and the cable 5.

In the present invention, because the soldering portions 2116, 2118, 2217, 2219 are both two numbered, with one thereof extending upward and then rightward bending, while the other one extending downward and then leftward bending such that one faces towards the other in a vertical direction, impedance thereof is reduced and therefore, signal is more rapidly transmitted. Because the second grounding terminal 25 comprises the main plate 251 separating the soldering portions 2217, 2219 of the second terminals 22, crosstalk is prevented. Because the insulative housing 1 forms a plurality of ribs 13 extending rearward from the base portion 11, and the ribs 13 divide the soldering portions 211, 221 one from the other, and therefore, the soldering portion 211, 221 are prevented from being damaged in the following welding between the soldering portion 211, 221 and the cable 5, and the following molding of the insulative cover 6. The electrical connector assembly 100 avoids shorting too because the ribs 13 prevent the adjacent ribs 13 from riskily being connected with each other. Overall, the electrical connector assembly 100 of the present invention can efficiently and error-freely transmit signals therethrough.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly, comprising:

an insulative housing comprising a base portion and a tongue portion integral with the base portion, the insulative housing defining a mating direction;

a plurality of contacts assembled in the insulative housing, the contacts having a plurality of contacting portions received in the tongue portion and partly extending beyond the tongue portion and a plurality of soldering portions extending rearward out of the base portion, the soldering portions comprising at least one pair of upper-and-lower soldering portions, each upper soldering portion opposingly facing a corresponding lower soldering portion in a vertical direction perpendicular to the mating direction, the soldering portions alternately bending sidewardly from the corresponding contacts and being located at horizontal planes different than a common plane defined by the contacting portions; and a cable connected with respective soldering portions of the contacts.

2. The electrical connector assembly as claimed in claim 1, wherein the upper soldering portion in a pair rightward bends and the lower soldering portion in the same pair leftward bends to face the upper soldering portion.

3. The electrical connector assembly as claimed in claim 1, wherein the contacts comprise a pair of upper-and-lower transmitting terminals, a pair of upper-and-lower receiving terminals, and a grounding terminal located between the transmitting terminals and the receiving terminals, and the grounding terminal comprises a soldering portion extending in an upper horizontal plane as the upper soldering portions.

4. The electrical connector assembly as claimed in claim 3, wherein the grounding terminal comprises a main plate separating the soldering portions of the transmitting terminals from the soldering portions of the receiving terminals for preventing crosstalk.

5. The electrical connector assembly as claimed in claim 3, wherein one receiving terminal which is adjacent to the grounding terminal slantwise extends upward and then horizontally bends away from the grounding terminal to extend over the other one receiving terminal.

6. The electrical connector assembly as claimed in claim 1, wherein the insulative housing forms a plurality of ribs extending from the base portion along the mating direction and the ribs are located at upper and lower parts of the base portion relative to the tongue portion.

7. The electrical connector assembly as claimed in claim 6, wherein the ribs divide the adjacent soldering portions.

8. The electrical connector assembly as claimed in claim 7, wherein the ribs extends at least up to rear edges of the soldering portions.

9. The electrical connector assembly as claimed in claim 7, wherein at least some of the ribs define a cutout for accommodating a corresponding soldering portion.

10. The electrical connector assembly as claimed in claim 1, further comprising a shield including a first metal cover and a second metal cover cooperatively receiving the insulative housing.

11. The electrical connector assembly as claimed in claim 10, wherein the first metal cover comprises a casing portion receiving the tongue portion and a flat portion associates with the second metal cover for receiving the base portion.

12. An electrical connector assembly comprising:

an insulative housing defining a base and a mating tongue forwardly extending therefrom;

a plurality of contacts disposed in the housing in a transverse direction, each of said contacts including a main body extending in a vertical plane perpendicular to said transverse direction, a mating section extending forwardly, along a mating direction perpendicular to said transverse direction, from the main body exposed upon the mating tongue in essentially the same vertical plane, and a soldering section extending rearwardly, along an un-mating direction opposite to said mating direction, from the main body and defining a horizontal plane perpendicular to said vertical plane under condition that said soldering sections essentially extend out of a rear face of the housing for soldering to corresponding wires; and the soldering section of one of said contacts extends in said transverse direction from an upper portion of the corresponding main body toward the adjacent contact, while the soldering section of said adjacent contact extends in an opposite transverse direction from a lower portion of the corresponding main body toward said one contact; wherein said soldering section of said one contact is spaced from and opposite to the soldering section of the adjacent contact in an at least partially overlapped manner in a vertical direction perpendicular to both said transverse direction and said mating direction.

13. The electrical connector as claimed in claim 12, wherein one of said contacts is a grounding contact under condition that the main body of said grounding contact extends rearwardly beyond said rear face of the housing and further extends rearwardly between the soldering sections of the neighboring contacts in said transverse direction while the main body of remaining of said contacts do not.

14. The electrical connector as claimed in claim 13, wherein the exposed main body of said grounding contacts outside of the housing is enlarged beyond the soldering sections of the remaining of the contacts not only in the vertical direction, but also in the mating direction.

15. The electrical connector as claimed in claim 12, wherein said housing further includes a plurality of rearwardly extending ribs on the rear face to isolate the soldering sections of the neighboring contacts under condition that said soldering sections abut against the ribs, respectively.

16. The electrical connector as claimed in claim 12, wherein the soldering section of said one contact extends in said transverse direction toward the adjacent contact but not beyond the vertical plane defined by the main body of the adjacent contact, and similarly, the soldering section of said adjacent contact extends in the opposite transverse direction toward said one contact but not beyond the vertical plane defined by the main body of said one contact.

17. The electrical connector as claimed in claim 12, wherein said soldering section of the one contact extends in said transverse direction toward the adjacent contact but not beyond the vertical plane defined by the main body of the adjacent contact, while differently, the soldering section of said adjacent contact extends in the opposite transverse direction toward said one contact and beyond the vertical plane defined by the man body of said one contact.

18. An electrical connector assembly comprising:

an insulative housing defining a base and a mating tongue forwardly extending therefrom;

five contacts disposed in the housing in a transverse direction, each of said contacts including main body extending in a vertical plane perpendicular to said transverse direction, a mating section extending forwardly, along a mating direction perpendicular to said transverse direction, from the main body exposed upon the mating tongue, and a soldering section extending rearwardly, along an un-mating direction opposite to said mating direction, from the main body and defining a horizontal plane perpendicular to said vertical plane under condition that said soldering sections essentially extend out of a rear face of the housing for soldering to corresponding wires; and a middle one of said five contacts being a ground contact and dividing the remaining four contacts into first and second pairs by two sides thereof; wherein in the first pair, the soldering section of an outer contact extends transversely toward an inner contact but not beyond the vertical plane defined by the main body of an inner contact, and similarly, the soldering section of the inner contact extends transversely toward the outer contact but not beyond the vertical plane defined by the main body of the outer contact under condition that said two soldering sections are located at two different levels; in the second pair, said soldering section of an outer contact extends toward the inner contact but not beyond the vertical plane defined by the main body of the inner contact, while differently, the soldering section of said inner contact extends transversely in the opposite transverse direction toward said one contact and beyond the vertical plane defined by the man body of said outer contact under condition that said two soldering sections are located at two different levels.

19. The electrical connector assembly as claimed in claim 18, wherein the grounding contact defines an extended main body beyond the rear face of the housing and dimensioned to exceed the soldering sections of said two pairs of contacts in both the un-mating direction and a vertical direction which is perpendicular to both the transverse direction and the un-mating direction, under condition that the soldering section of said two pair of contacts are roughly symmetrically arranged with each other relative to said extended main body.

* * * * *